United States Patent [19]

Gulati et al.

[11] 4,270,380

[45] Jun. 2, 1981

[54] METAL SHAPING DIE ASSEMBLY

[75] Inventors: Suresh T. Gulati, Elmira; Henry E. Hagy, Painted Post, both of N.Y.

[73] Assignee: Corning Glass Works, Corning, N.Y.

[21] Appl. No.: 42,581

[22] Filed: May 25, 1979

[51] Int. Cl.[3] ..... B21C 3/02

[52] U.S. Cl. ..... 72/467

[58] Field of Search ..... 72/467

[56] References Cited

U.S. PATENT DOCUMENTS

| | | | |
|---|---|---|---|
| 2,150,734 | 3/1939 | Unckel | 72/467 |
| 2,882,759 | 4/1959 | Altwicker | 72/467 X |
| 3,613,433 | 10/1971 | Deverell et al. | 72/467 |

FOREIGN PATENT DOCUMENTS

| | | | |
|---|---|---|---|
| 633634 | 11/1978 | U.S.S.R. | 72/467 |

*Primary Examiner*—Milton S. Mehr

*Attorney, Agent, or Firm*—Richard N. Wardell

[57] ABSTRACT

A die assembly comprises a steel casing shrink-fitted onto and holding a ceramic die nib for extruding, drawing, ironing and the like of ferrous and nonferrous metal stock, especially in hot workable condition. The assembly includes an interlayer between the nib and casing to accommodate imperfect dimensional mating of adjacent shrink-fitted surfaces of the nib and casing. The interlayer is composed of all-crystalline ceramic material having a heating liquidus temperature within the range of 500°-570° C. Rigidity of solidified interlayer maintains uniform shrink-fitted compression on nib during usage of the assembly. Nib and preferred lead-zinc-borate devitrified glass interlayer are easily, jointly removable from casing and leave casing clean for reuse without affecting its case-hardening properties.

9 Claims, 1 Drawing Figure

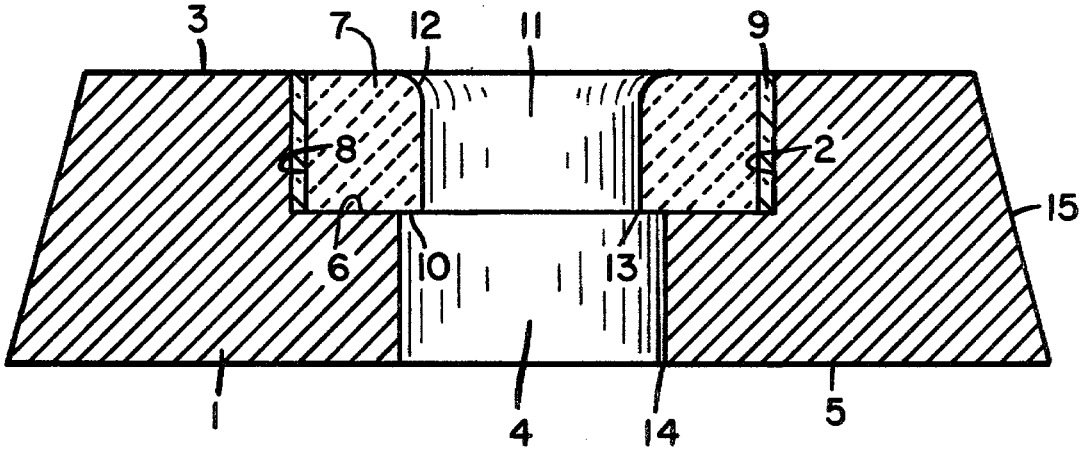
3
7
12
11
9
8
2
15
6
10
13
1
4
14
5

METAL SHAPING DIE ASSEMBLY

BACKGROUND OF THE INVENTION

Ceramic die nibs or inserts held within a steel casing for shaping of metal forced therethrough have been known for well over the past half-century. An early disclosure of such cased die nibs for wire drawing is in U.S. Pat. No. 1,096,688.

These ceramic die nibs have a propensity to suffer tensile stress failure in use. It was later found that this problem could be substantially alleviated by making the outside diameter of the nib very slightly larger than the inside diameter of the casing portion designed to surround the nib, then heating the casing to expand its noted inside diameter large enough to receive the nib (which is at room temperature), and lastly cooling the assembly to shrink-fit the casing onto and around the nib. Such shrink-fitted assembly placed the nib under sufficient compression to offset the tensile stress resulting from metal forced through a shaping aperture of the nib.

In order to avoid cracking of the nib during shrink-fitting into the casing, it became necessary to carefully grind and finish the outer circumferential surface of the nib to the same circumferential geometry as that of the surrounding inner circumferential surface of the casing, e.g. to concentricity between them. Otherwise, irregular or out-of-round mating between nib and casing caused uneven stresses in the nib that often produced early cracking of the nib (even during casing thereof).

However, the cost burden of such nib finishing work led to the discovery that such work could be substantially avoided by designing the assembly to accommodate a compressed intermediate layer of relatively low melting point glassy or resinous material between the shrink-fitted surfaces of the nib and casing as shown in U.S. Pat. No. 2,150,734. In addition to glassy or soft oxide material, U.S. Pat. No. 3,013,657 suggested the use of soft pure metal for the intermediate layer. U.S. Pat. No. 3,613,433 discloses relatively high-silica glaze or glassy materials which are incidentally shown between the shrink-fitted nib and casing. Because of their high $SiO_2$ content, the glassy materials in this latter patent are believed to have somewhat higher softening points than suggested by the other noted patents, e.g. that of Glaze 7 is estimated to be about 1050° C.±50° C. and the lowest of the disclosed glazes or vitreous coatings. In each of these cases, the assembly design involved an intermediate layer of material that could be heated to a liquid type of flowable condition or melted at a temperature well below the melting temperatures of the nib and casing, and during shrink-fitting the heated flowable or melted material could easily fill the shrinking space between nib and casing. Moreover, such material was of a relatively plastic and gradually hardening (thermoplastic) nature as it cooled with the nib and casing. While cooling glassy and resinous materials undergo substantially continuous increase in viscosity to a rigid state at room temperature, cooling metals solidify to a relatively plastic state (subject to creep under pressure) that continues to get stiffer and more rigid as cooling continues. Thus, these earlier designs were also apparently predicated on some plastic flow of the intermediate material during cooling of the shrink-fitted assembly so as to further accommodate any irregular or out-of-round, outer, circumferential surface of the nib and its mating with the casing.

In the U.S. Air Force sponsored report ML-TDR-64-295 (or AD 608497) by Hunt et al. and dated Nov. 25, 1964, it is also proposed to insert a relatively softer metal (e.g. copper or aluminum) sleeve cushion between the shrink-fitted nib and casing without melting this cushion.

Ceramic die nibs of particular interest today are those made essentially of zirconia like those disclosed in U.S. Pat. No. 3,365,317 and the July 1, 1965 issue of The Iron Age magazine at pages 58–59.

SUMMARY OF THE INVENTION

Our invention relates to an improved die assembly for shaping metal by extrusion, drawing, ironing and the like. It is especially useful in shaping hot metal, which can be of various kinds of ferrous and nonferrous metals. The assembly comprises: (1) a ceramic die having at least one aperture therein for passage of metal therethrough to work same whereby the shape and/or cross-section of the metal entering and exiting the nib is dissimilar, and (2) steel casing means to support the nib against axial displacement in the direction of the aperture and against tensile failure in use. The nib has an outer annular surface with a coating thereon, and the casing means has an inner annular surface shrink-fitted onto and around the coated outer annular surface of the nib.

We have discovered that greatly and reliably improved service life is attained in such die assembly by forming the coating, constituting the compressed interlayer between the nib and casing means, of all-crystalline ceramic material having a heating liquidus temperature within the range of 500°–570° C. (preferably 510°–530° C.). Such material can be applied as a coating on the outer annular surface of the nib before it is shrink-fitted into the casing. This coating readily melts upon insertion of the nib into the steel casing means heated to a temperature above the heating liquidus temperature of such coating, but not high enough to anneal the steel casing to an undesirable degree of softness. As the casing cools, this coating solidifies to the rigid state common of fully crystalline ceramics such that, when the die assembly becomes reheated in use for and by shaping hot metal, the coating or interlayer does not become softened or plastic (or subject to noticeable creep) and is not forced out from between the nib and casing since its temperature is well below the heating liquidus. Thus, this rigid coating or interlayer not only maintains its rigid integrity but also maintains its original, proper, shrink-fitted, circumferentially equalized compression on the nib to overcome or offset tensile stress resulting from metal forced through an aperture of the nib during usage of the assembly.

This invention, with its noted unique interlayer, makes it very easy to remove and replace the nib. The assembly is merely heated above the heating liquidus temperature of the interlayer or coating to a temperature as previously noted for casing, whereupon the interlayer becomes melted, and then the nib is easily pushed out of the casing to permit reuse of the casing.

Our invention is especially beneficial when the nib is formed of zirconia ceramic and the casing means is formed of case-hardened steel.

BRIEF DESCRIPTION OF DRAWING

The sole FIGURE is a diametral cross-section view of a preferred, illustrative embodiment of the die assembly according to the invention disclosed and claimed herein.

DETAILED DESCRIPTION

Steel casing 1 is formed with a centrally disposed orifice extending through the casing substantially along the axis of the casing. That orifice is of two axially adjacent and aligned portions defined by separate inner annular surfaces 2,4. The larger diameter portion or surface 2 opens at entrance face 3 of casing 1. That orifice portion 2 is of greater cross-sectional area transverse of the casing axis than that of the other orifice portion 4, which opens at the opposite, exit face 5 of casing 1. The two inner annular surfaces 2,4 are connected by inner supporting surface 6, which extends substantially transverse of the axis casing 1 (similar to entrance and exit faces 3,5). While casing 1 may be formed of any suitable steel, we prefer to make it of AISI Type H12 or H13 hardened tool steel and especially with such steel case-hardened to have a surface hardness of at least about Rockwell C-50 retained upon being tempered and reheated at temperatures up to about 593° C.

Ceramic die nib or insert 7 is formed with an outer annular surface 8 having the all-crystalline ceramic coating or interlayer 9 thereon, both of which axially extend from entrance face 3 to exit face 10 of nib 7. Centrally disposed within nib 7 is aperture 11 in axial alignment with the axis of casing 1 and extending from entrance face 3 to exit face 10 of the nib 7. In our best mode of the invention, the junction 12 of the entrance face 3 of the nib 7 with aperture 11 is formed by a rounded annular shoulder to facilitate passage of the metal to be worked into and through aperture 11. As is customary and known, the metal to be worked has an outer perimeter extending beyond the diametral space limitation of aperture 11 whereby passage of such metal into and through aperture 11 effects extrusion, drawing, ironing or the like of such metal. If desired, junction 12 may be squared-off or beveled. While nib 7 may be formed of any suitable ceramic, we prefer to make it of a zirconia ceramic (either partially or fully stabilized) and especially of a partially stabilized zirconia ceramic, e.g. like that disclosed in U.S. Pat. No. 3,365,317. In particular, we prefer to use such ceramic with either of the following two nominal compositions (analytically by weight):

| Composition: | 1 | 2 |
|---|---|---|
| MgO | 3.3 | 3.1 |
| $SiO_2$ | 0.2 | 0.8 |
| $ZrO_2$ plus incidental impurities | balance | balance |

The coating 9 can be formed of any suitable fully crystalline ceramic material with the requisite heating liquidus temperature. However, in our best mode, we form it from devitrified lead-zinc-borate glass frit and especially with such frit consisting essentially, analytically by weight, of 70–82% PbO, 7–16% ZnO and 6.5–12% $B_2O_3$. That devitrified frit coating is made from undevitrified glass frit of the same composition and as set forth in British Pat. No. 863,500. Optionally, the frit can have a minor amount (up to 35 wt.% of mixture) of comminuted refractory material, such as oxide and/or silicate, added to and intimately mixed with it as disclosed in U.S. Pat. Nos. 3,250,631 and 3,258,350. In particular, we prefer to use a mixture of 98.75 wt.% glass frit (−100 mesh), 1.00 wt.% zircon (−325 mesh) and 0.25 wt.% silica (−200 mesh), in which the glass frit typically consists essentially (analytically by weight) of about 75.4% PbO, 12.15% ZnO, 8.4% $B_2O_3$, 2.05% $SiO_2$, 1.9% BaO and 0.1% $Al_2O_3$. This glass frit has a devitrification temperature of about 435° C., above which it becomes all-crystalline as determined by X-ray diffraction analysis. The resultant devitrified frit has a heating liquidus (or crystalline remelt) temperature of about 515° C. The frit-zircon-silica mixture is dry blended by ball milling, and then it is mixed with a suitable vehicle for spraying, painting or otherwise coating it onto outer annular surface 8 of nib 7. We prefer to form a sprayable mixture of 100 grams of the frit-zircon-silica mixture blended with 60 cc of a vehicle solution consisting of 1.2 wt.% nitrocellulose in amyl acetate. Using a conventional commercially available spray gun, this sprayable mixture is sprayed onto surface 8 as it rotates at about 120 rpm and in several passes or layers thereof, with hot air drying of each pass or layer with a conventional, commercially available, electric heat gun or other hot air heating source. Optionally, drying can be done after completion of all spraying, either at room temperature or at slightly elevated temperature (e.g. 85° C.) in air.

The ultimate desired thickness of the frit coating determines the number of passes or layers sprayed onto surface 8. Such thickness can be varied as desired, depending upon the preferred diametral dimensions of the outer annular surface 8 and inner annular surface 2, to provide the desired diametral interference (i.e. difference in diametral dimensions) between the larger diameter of the devitrified coating or interlayer and the smaller diameter of surface 2. Such diametral interference determines the amount of shrink-fit compression on coating 9 and nib 7. Since the undevitrified frit mixture shrinks approximately 50% by volume upon being fired to devitrify and sinter it, the green or undevitrified thickness of coating 9 must be generally twice the desired fired or devitrified thickness of coating 9. Firing of the undevitrified coating to produce the devitrified and sintered coating is preferably done at about 450°–470° C. in a furnace for about one-half hour. By way of example, we have suitably employed fired coating thicknesses of about 2.5–10 mils (0.06–0.25 mm) on nibs with an outside diameter of about 2 inches (5 cm) to produce diametral interferences of about 5–15 mils (0.13–0.38 mm) with their casings, and we have suitably employed fired coating thicknesses of about 3.5–8 mils (0.09–0.20 mm) on nibs having an outer diameter of about $4\frac{3}{4}$ inches (12 cm) to provide diametral interferences of about 25–33 mils (0.63–0.84 mm).

For inserting a coated nib (at room temperature) into a casing, we prefer to heat the casing so as to expand its inner opening portion 2 to provide a diametral clearance of about 1–2 mils (0.03–0.05 mm) beyond the outer diameter 8 of the nib. Of course, it is also possible to chill the coated nib in liquid nitrogen to shrink its outer diameter 8 to provide similar insertion clearance into a casing at room temperature. However, heating of the casing seems more convenient, especially by doing so according to conventional induction heating procedures heretofore commercially employed. Generally for die assemblies made with out preferred materials for the casing and coating, heating the casing to temperatures above the heating liquidus temperature of the coating and in the range of about 550°–590° C. (preferably about 566° C.) is satisfactory. It is generally necessary to avoid heating such casings over about 590° C. so as not to reduce their case hardness to an unsatisfactory level for further use (without reheat-treatment to reharden them even if that might be possible).

After casing 1 has been properly heated for insertion of nib 7 and nib 7 has been placed into the opening portion 2 to rest against supporting surface 6, it is preferable to direct a source of heat (e.g. hot air from a heat gun) against the inside surface 11 of nib 7 to minimize temperature gradients in nib 7 as cooling and shrinking of casing 1 begins. We found that setting the heat gun to produce 700° C. temperature and applying that heat from it to surface 11 for about the initial 120 seconds of cooling of the casing 1 gave satisfactory results, including helping the onset of precompression (due to expansion of nib 7 until its temperature equalized with that of casing 1). Thereafter, the assembly is allowed to cool to room temperature and is ready for use in the desired metal working or shaping press.

Several optional modifications may be desirably employed in the assembly of our invention. First, the sharp edge 13 at the junction of aperture 11 and surface 10 can be rounded or beveled, either in a simply or compound manner to provide better service life to nib 7 or better surface finish on the worked/shaped metal passing through aperture 11. Similarly, edge 14 at the junction of opening portion 4 and exit face 5 can be rounded or beveled, also either in simple or compound manner and even extending up to about surface 6 to facilitate better service life and/or surface finish. Casing 1 may have an outer annular surface 15 that is conically tapered toward entrance face 3, either for part or all of the length of casing 1 between entrance face 3 and exit face 5. When such tapered surface is for only part of that length, it can be either intermediate such faces (without joining directly to them) or it can directly join one or the other of such faces. The particular choice depends on the design of the press into which the die assembly is to be mounted and the likely strength benefit thereby accorded to the die assembly. Of course, if desired, the outer annular surface 15 can be made parallel with the casing axis.

Uncasing of the nib 7 (i.e. removal of it from casing 1) is readily accomplished by reheating the casing 1 by the conventional induction heating to a temperature above the heating liquidus of interlayer 9. For our best mode interlayer 9, that means a temperature above about 515° C. and we prefer about 538° C. When casing 1 is adequately heated to such temperature, the nib 7 is easily pushed out of casing 1 with a simple hydraulic press ram exerting slight pressure on exit face 10 of nib 7. After so removing nib 7 from casing 1, the inner annular surface 2 and supporting surface 6 of the casing 1 is left clean and free of interlayer 9. We found that this beneficial result is consistently obtained with the interlayer formed of lead-zinc-borate devitrified glass frit. Apparently, such frit is relatively strongly bonded to the ceramic nib and not significantly bonded to the steel casing. Thus the emptied casing is left clean and ready for reuse.

We claim:

1. In a die assembly for shaping metal by extrusion, drawing, ironing and the like, which comprises a ceramic die nib having at least one aperture therein for passage of metal therethrough to work same whereby the shape and/or cross-section of the metal entering and exiting said nib is dissimilar, the nib having an outer annular surface with a coating thereon, and steel casing means to support the nib against axial displacement in the direction of the aperture and against tensile failure in use, the casing means having an inner annular surface shrink-fitted onto and around the coated outer annular surface of the nib, wherein the improvement comprises the coating being composed of all-crystalline ceramic material having a heating liquidus temperature within the range of 500°–570° C. and which does not become softened or plastic or subject to noticeable creep when reheated in use of the die assembly for and by shaping hot metal.

2. In the assembly of claim 1 wherein (a) the steel casing means has a centrally disposed orifice extending therethrough substantially along the axis of the casing means, the orifice being of two axially adjacent and aligned portions defined by separate inner annular surfaces, a larger diameter one of the portions opening at an entrance face of the casing means substantially transverse of the casing means axis and being of greater cross-sectional area transverse of the casing means axis than that of the other portion opening at an opposite exit face of the casing means substantially transverse of the casing means axis, the inner annular surface of the larger diameter opening portion being shrink-fitted onto and around the coated outer annular surface of the nib, and an inner supporting surface extending substantially transverse of the casing means axis and connecting the two inner annular surfaces, and (b) the nib has an entrance face substantially transverse of the casing means axis, an exit face substantially transverse of the casing means axis and resting against the inner supporting surface of the casing means, and one said aperture centrally disposed therein in axial alignment with the casing means axis and extending from the entrance face to the exit face of the nib.

3. In the assembly of claim 2 wherein the casing means has an outer annular surface conically tapered toward the entrance face of the casing means substantially from the exit face thereof.

4. In the assembly of claim 2 wherein the junction of the entrance face of the nib with the aperture is formed by a rounded annular shoulder.

5. In the assembly of claim 1, 2, 3, 4, or wherein the ceramic material of the coating consists essentially of a devitrified lead-zinc-borate glass frit.

6. In the assembly of claim 5 wherein the glass consists essentially, analytically by weight, of 70–82% PbO, 7–16% ZnO and 6.5–12% $B_2O_3$.

7. In the assembly of claim 6 wherein the frit is mixed with a minor amount of comminuted refractory material.

8. In the assembly of claim 2 wherein the casing means has an outer annular surface conically tapered toward the entrance face of the casing means substantially from the exit face thereof and the junction of the entrance face of the nib with the aperture is formed by a rounded annular shoulder.

9. In the assembly of claim 5 wherein the nib is formed of zirconia ceramic.

* * * * *

UNITED STATES PATENT AND TRADEMARK OFFICE

CERTIFICATE OF CORRECTION

PATENT NO. : 4,270,380

DATED : June 2, 1981

INVENTOR(S) : Suresh T. Gulati and Henry E. Hagy

It is certified that error appears in the above-identified patent and that said Letters Patent are hereby corrected as shown below:

Column 6, line 51, claim 5, after "or" and before "wherein" add -- 8 --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*